US006453634B1

(12) United States Patent
Pryor

(10) Patent No.: US 6,453,634 B1
(45) Date of Patent: Sep. 24, 2002

(54) MOMENT-RESISTING STRAP CONNECTION

(75) Inventor: Steven E. Pryor, Dublin, CA (US)

(73) Assignee: Simpson Strong-Tie Company, Inc., Dublin, CA (US)

( * ) Notice: Subject to any disclaimer, the term of this patent is extended or adjusted under 35 U.S.C. 154(b) by 0 days.

(21) Appl. No.: 09/728,186

(22) Filed: Dec. 1, 2000

(51) Int. Cl.[7] ..... E04B 1/38

(52) U.S. Cl. ..... 52/713; 52/713; 52/285.2; 52/293.3; 52/295

(58) Field of Search ..... 52/283, 284, 285.2, 52/293.3, 295, 299, 713, 699

(56) References Cited

U.S. PATENT DOCUMENTS

| | | | | | |
|---|---|---|---|---|---|
| 2,947,119 | A | * | 8/1960 | Puckett, Jr. | 52/699 |
| 4,744,192 | A | * | 5/1988 | Commins | 52/714 |
| 5,150,553 | A | * | 9/1992 | Commins et al. | 52/264 |
| 5,350,265 | A | | 9/1994 | Kinner | |
| 5,467,570 | A | * | 11/1995 | Leek | 52/712 |
| 5,595,031 | A | * | 1/1997 | Commins | 52/264 |
| 5,622,022 | A | | 4/1997 | Haisch | |
| 5,813,182 | A | * | 9/1998 | Commins | 52/295 |
| 5,979,130 | A | * | 11/1999 | Gregg et al. | 52/295 |
| 6,006,487 | A | * | 12/1999 | Leek | 52/698 |
| 6,158,184 | A | | 12/2000 | Timmerman, Sr. et al. | |
| 6,158,188 | A | * | 12/2000 | Shahnazarian | 52/702 |
| 6,244,004 | B1 | * | 6/2001 | Timmerman, Sr. et al. | 52/274 |
| 6,250,041 | B1 | * | 6/2001 | Seccombe | 52/712 |

FOREIGN PATENT DOCUMENTS

| | | |
|---|---|---|
| EP | 0 918 114 A2 | 5/1999 |
| WO | WO98/46839 | 10/1998 |

OTHER PUBLICATIONS

ICBO Evaluation Report PFC–5402 Issued Jul. 1, 1998 For STS Prefabricated Lateral–Force Resisting (LFR) Panel System.

Ser. No. 60/043,835, filed on Apr. 4, 1997, "Lateral Force Resisting System," invented by Timothy L. Timmerman.

Simpson Strong–Tie Company, Inc., "Strong–Wall Shearwall Garage Portal Systems and Installation Guide," Simpson Strong–Tie Company, Inc. (U.S.A.), p. 5, (Nov. 15, 1999).

Bulldog Simpson GmbH, "Crampons Bulldog," Bulldog Simpson GmbH, p. 2.

"Bolts, Lag Bolts, and Other Connectors: 13.14 Split Ring and Shear Plate Connectors," McGraw–Hill, Inc. (U.S.A.), p. 3, (1993, 1988, 19880).

Alfred D. Commins and Robert C. Gregg, "Cyclic Performance of Tall–Narrow Shearwall Assemblies," p. 12, (Apr. 5, 1994).

Bulldog Simpson GmbH, "Statische Berechnungen Simpson—HRB—Verbinder Teil 1—Zuganker und Schwellenanker," Bulldog Simpson GmbH (Syke (Germany)), p. 2, (Nov. 15, 1998).

* cited by examiner

*Primary Examiner*—Carl D. Friedman
*Assistant Examiner*—Brian E. Glessner
(74) *Attorney, Agent, or Firm*—James R. Cypher; Charles R. Cypher

(57) ABSTRACT

A moment resisting strap connection in a shear-resisting assembly for use in light frame building construction, particularly in shear walls, attached to a foundation. The improvement includes providing an elongated thin metal strap attached to a wood structural member such that the strap and wood structural member conjointly act compositely and transmit substantial shear and moment forces from the elongated structural member to the foundation. Further enhanced transfer of shear and moment forces from the wood structural member to the foundation is effected by providing sufficient fasteners such as screws between the strap, a holdown, and the wood structural member to stitch the elements together so as to stiffen them and thereby prevent bending of the end of the holdown.

10 Claims, 4 Drawing Sheets

MOMENT-RESISTING STRAP CONNECTION

This invention relates to a shear-resisting assembly, and a shear-resisting construction unit, in which a moment-resisting strap is attached to an elongated structural member subject to moment and shear forces. A typical use for the strap would be in a shear-resisting assembly such as a post attached to a foundation, or in a shear-resisting construction unit used in a building wall attached to a foundation, or it could simply be used for attachment of another structural wood member to a relatively immovable structure.

BACKGROUND OF THE INVENTION

A recent development in the building industry, particularly for framed homes of either wood or metal, or for light commercial or apartment buildings is the use of prefabricated shear-resisting construction units in walls for resisting lateral forces imposed on the building. An example of one such shear-resisting construction unit used in walls is described in U.S. patent application Ser. No. 08/975,940 filed Nov. 21, 1997. A commercial embodiment of a similar shear resisting construction unit used in walls is illustrated in a brochure published by Simpson Strong-Tie Company, Inc. entitled "Strong-Wall™ Shearwall" and having a designator F-SW16HD May 1999 exp. June 2000 and bearing a copyright notice dated 1999. These shear-resisting construction units used as prefabricated components for walls provided a major step forward in providing consistent lateral resistance in buildings in the light frame industry.

SUMMARY OF THE INVENTION

Applicant found, however that such shear-resisting construction units could be greatly strengthened at little increase in cost, weight, and installation time by installing a moment-resisting strap at a crucial location in the structure in combination with a holdown connector and joined by adhesive or fastener elements such as wood screws.

The strengthened construction unit results from a composite effect in which the moment-resisting strap acts in combination with other elements to give a far greater resistance to shear and moment forces than would have been possible had the elements acted alone instead of compositely together.

The theory of the operation of these elements is further described in the specification under the headings "Operation of the Moment-resisting Elongated Strap in the First Shear Resisting-assembly; "Operation of the First and Second Moment-resisting elongated straps in the Shear-resisting Construction Unit", and "Composite Effect".

A further enhancement effect occurs when the screws are used in sufficient number and in sufficiently close spacing to literally stitch substantially the entire back of the holdown to the moment-resisting strap and to a substantial portion of the wood structure so that a shear-resisting assembly of substantial length is stiffened and acts as a stiffened unit to transmit bending moments from the elongated wood structure to the foundation. Such a unit is extremely effective in reducing premature failure in the wood structural member due to bending. The moment resisting elongated strap extends to or slightly beyond the lower extremity of the holdown. The stitching effect of the multiple screws causes the holdown, a substantial portion of the moment resisting elongated strap, and a substantial portion of the elongated wood structure to act as a stiffened unit in resisting bending.

DESCRIPTION OF A BROAD FORM OF THE INVENTION

Figure 1:
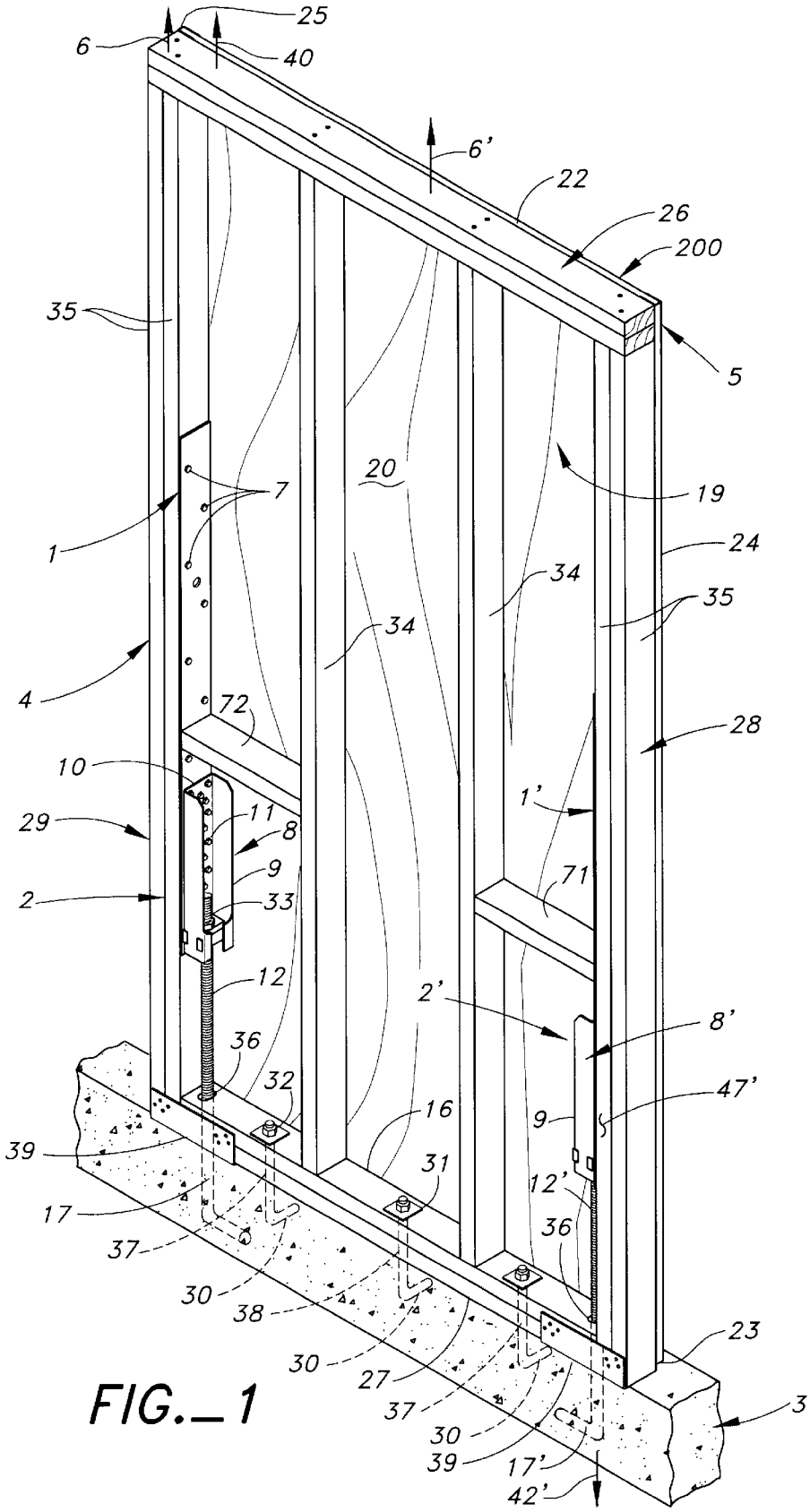
FIG. 1 is a perspective view of the moment-resisting strap of the present invention installed in a first shear-resisting assembly and shear-resisting assembly construction unit which under wind or seismic conditions develops moment and shear forces in the side structural members which must be transmitted through a holdown member connected to an anchor member which in turn is connected to a concrete foundation.

The present invention consists of a moment-resisting strap connection in a first shear-resisting assembly 2. In a broad form of the invention, the shear-resisting assembly includes a relatively immovable member 3 and an elongated structural member 4 subject to lateral and shear forces 5 and 6.

The moment-resisting strap connection includes an elongated moment-resisting strap 1 positioned in registration with elongated structural member 4 and attached with first attachment means 7 at sufficient multiple locations and in a manner such that substantial shear and moment forces are transmitted from a substantial length and cross section of the structural member 4 to the relatively immovable member 3; a holdown member 8 formed with or without longitudinal stiffening means 9 and having a face member 10 positioned in abutting relation to the elongated moment-resisting strap 1 and eccentrically operably connected to the relatively immovable member 3; and a plurality of second attachment means 11 connecting a substantial portion of the face member 10 of the holdown 8 to the elongated moment-resisting strap 1 and the elongated structural member 4, so as to transmit moment and shear forces from the structural member 4 to the relatively immovable member 3.

The second attachment means 11 which are preferably screws must be of sufficient number and spaced sufficiently in close relation to cause the holdown face member 10, moment resisting elongated strap 1, and elongated structural member 4 to act as a unitary assembly in resisting bending moment.

For enhanced stiffening, the holdown should have longitudinal stiffening means such as flanges 9.

In a broad form of the invention, described under the heading "Preferred embodiment", the shear-resisting construction unit 200 includes a pair of holdowns 8 and 8', first and second chords 28 and 29, a planar shear-resisting element 19 as well as other elements.

The relatively immovable member 3 may be a concrete foundation; the first attachment means 7 are wood screws; the stiffening means 9 is at least one flange connected to a substantial portion of the face member 10 of the holdown member. The eccentric connection includes an anchor 12 embedded in the relatively immovable member 3 connected to a bracket 13 on the holdown member 8 integrally connected to the holdown face member 10. The second attachment means 11 may be a plurality of wood screw fasteners.

In the moment-resisting strap connection, a substantial portion of face member 10 of holdown 8 including the lower end 14 is positioned in abutting relation to the elongated moment resisting strap 1. Note in FIG. 3 that the end 15 of the elongated strap 1 should extend to a point just beyond the lower end 14 of the holdown 8 for best results.

Figure 3:
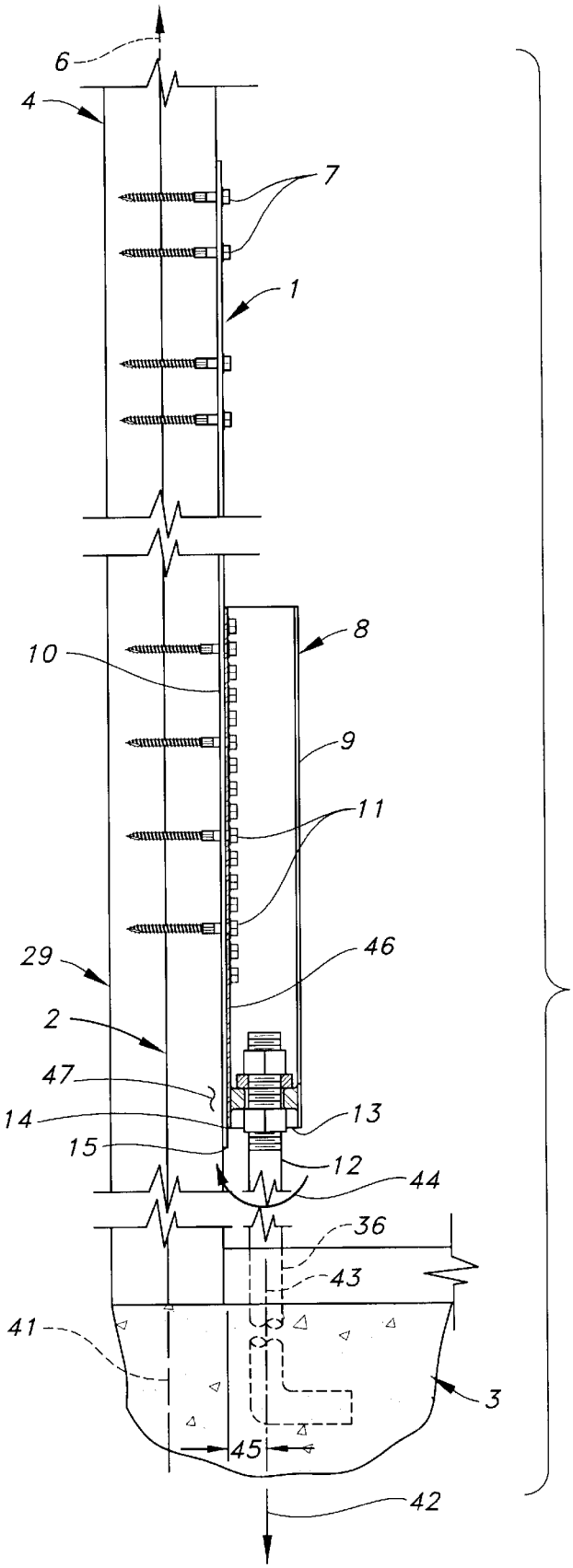
FIG. 3. is an enlarged cross sectional view of the holdown shown in FIG. 2. The strap of the present invention, the end post and the mudsill are shown, but not shown in cross section for purposes of clarity.

FIG. 3 illustrates a portion of the first shear-resisting assembly 2 and shear-resisting construction unit 200 shown in FIG. 1. Elongated structural member 4 may be a double stud member. If the double stud member were simply a stand alone post anchored to a concrete slab, as the illustration suggests, the moment-resisting strap connection of the present invention would operate equally successfully and in the same manner as described for the preferred embodiment.

Another use for the moment-resisting strap connection would be within a building structure where the holdowns are connected to a wood portion of the structure instead of to the concrete foundation. Again, the moment-resisting strap connection would be equally effective.

DESCRIPTION OF THE PREFERRED EMBODIMENT

In the preferred embodiment the moment resisting strap connection is used in a shear-resisting construction unit 200 which is used in light-frame building as a sub-component specifically designed to resist lateral forces imposed on the building such as those caused by an earthquake or by wind loading. Shear-resisting construction unit 200, as previously stated is fully described in U.S. patent application Ser. No. 08/975,940 and is sold extensively by the Simpson Strong-Tie Company, Inc. under the trademark Strong-Wall™.

As previously stated and as shown in FIG. 1, the relatively immovable member 3 can be a concrete foundation. Often, the shear resisting construction unit 200 will not rest on the foundation directly, but rather on a floor diaphragm resting on the foundation. In this case, the underlying relatively immovable member 3 becomes the floor diaphragm and the foundation. When the shear resisting construction unit 200 occurs at the second or third level of the building, the relatively immovable member 3 is the supporting floor diaphragms, lower levels and the foundation of the building.

The shear-resisting construction unit 200 is formed with a bottom plate 16 that rests on the underlying relatively immovable member 3 of the building. The bottom plate 16 is connected to the relatively immovable member 3 by anchor means 17 for connecting the bottom plate 16 to the relatively immovable member 3 of the building. In standard frame construction, a plurality of vertically-disposed studs are disposed on top of the bottom plate. These studs are connected to the bottom plate by fasteners, such as nails, for connecting the plurality of vertically-disposed studs to the bottom plate. A top plate is supported by and rests on the vertically-disposed studs. The top plate is connected to the vertically-disposed studs by means for connecting the top plate to the vertically-disposed studs.

The wall incorporates the shear-resisting construction unit 200 that is connected to the top plate of the wall and is also connected to the relatively immovable member 3. These connections allow lateral forces on the top plate of the wall and on the relatively immovable member 3 to be transmitted to the shear-resisting construction unit 200. The shear-resisting construction unit 200 is disposed between the top plate and the relatively immovable member 3. The shear-resisting construction unit 200 has a planar shear-resisting element 19. The planar shear-resisting element 19 has a proximal face 20, a distal face 21, a top edge 22, a bottom edge 23 and first and second side edges 24 and 25. The shear-resisting construction unit 200 includes a top strut 26 connected to the proximal face 20 near the top edge 22 of the shear-resisting element 19. The top strut 26 is disposed substantially parallel to the top plate of the wall. The shear-resisting construction unit 200 includes a bottom strut 27 connected to the proximal face 20 near the bottom edge 23 of the shear-resisting element 19. A first chord 28 is connected to the proximal face 20 near the first side edge 24 of the shear-resisting element 19. A second chord 29 is also connected to the proximal face 20 near the second side edge 25 of the shear-resisting element 19. The top and bottom struts 26 and 27 and the first and second chords 28 and 29 are connected to the shear-resisting element 19 by means such as nails or screw for connecting the top strut 26, the bottom strut 27, the first chord 28 and the second chord 29 to the shear-resisting element 19. The top and bottom struts 26 and 27 and the first and second chords 28 and 29 form a supporting frame for the shear-resisting element 19.

The shear-resisting construction unit 200 is connected to the top plate of the wall by means such as screws and is connected to the foundation 3 of the building by means 30.

In the preferred form of the invention, the bottom plate 16 of the wall, the plurality of vertically-disposed studs resting on the bottom plate 16, the top plate of the wall, the shear-resisting element 19 of the shear-resisting construction unit 200, the top and bottom struts 26 and 27 of the shear-resisting construction unit 200, and the first and second chords 28 and 29 of the shear-resisting construction unit 200 are all made of wood or wood composites. These members can also be made of steel or synthetic building materials.

As shown in FIG. 1, in the preferred form of the invention, when the relatively immovable member 3 is the foundation of the building, the means 17 for connecting the bottom plate 16 to the foundation 3 of the building are foundation anchors in the shape of bolts bent to form a mechanical interlock with the foundation. The inventor has found ⅝" diameter ASTM A307 or A36 foundation anchors embedded to a proper depth to be sufficient for most foundations. The length of the foundation anchors, the spacing between foundation anchors and placement of the foundation anchors in the foundation are determined according to the forces that are imposed on the wall and the strength of the foundation. The means 17 for connecting the bottom plate 16 to the foundation 3 of the building can also be strap anchors, mudsill anchors, bolts, retrofit bolts, foundation plate holdowns, straps, ties or a combination thereof. When the relatively immovable member 3 consists of a floor diaphragm and the foundation of the building, the means 30 for connecting the bottom plate 16 to the relatively immovable member 3 of the building can be nails, screws, bolts, retrofit bolts, framing anchors, angles, ties, plates, straps or a combination thereof. When the relatively immovable member 3 consists of a floor diaphragm, a supporting wall and the foundation, the means 17 for connecting the bottom plate 16 to the relatively immovable member 3 of the building can be nails, screws, bolts, foundation bolts, retrofit bolts, framing anchors, angles, ties, plates, straps or a combination thereof. When the relatively immovable member 3 consists of a plurality of floor diaphragms, a plurality of supporting walls and the foundation, the means 17 for connecting the bottom plate 16 to the relatively immovable member 3 of the building can be nails, screws, bolts, retrofit bolts, framing anchors, angles, ties, plates, straps or a combination thereof.

The preferred means for connecting the top strut 26, the bottom strut 27, the first chord 28 and the second chord 29 to the shear-resisting element 19 are 10d common 0.148"×3" nails, but screws, welds, clips, ties, brackets, angles staples, adhesives or a combination thereof can also be used. As shown in FIG. 1, nails should usually be spaced 2" apart around the shear-resisting element 19 near the top and bottom edges 22 and 23 and the first and second side edges 24 and 25 to achieve maximum shear resistance without causing splitting of the shear-resisting element 19.

The preferred means for connecting the shear-resisting construction unit 200 to the top plate of the wall are top plate fasteners having a threaded shank portion, but nails, welds, bolts, straps, brackets, ties, angles, anchor plates, clips, framing anchors or a combination thereof can also be used. The preferred top plate fasteners are ¼"×6" Simpson Strong Drive™ Screws. The top plate fasteners are inserted through the top strut 26 of the shear-resisting construction unit 200 and into the top plate of the wall. The number of top plate fasteners is dependent on the lateral loads the shear-resisting construction unit 200 is expected to carry and the strength of the top plate fasteners.

The means 30 for connecting the shear-resisting construction unit 200 to the foundation 3 of the building can also be strap anchors, mudsill anchors, bolts, retrofit bolts, foundation plate holdowns, straps, of ties or a combination thereof. When the relatively immovable member 3 consists of a floor diaphragm and the foundation of the building, the means for connecting the shear-resisting construction unit 200 to the relatively immovable member 3 of the building can be nails, screws, bolts, retrofit bolts, framing anchors, angles, ties, plates, straps or a combination thereof. When the relatively immovable member 3 consists of a floor diaphragm, a supporting wall, and the foundation, the means 30 for connecting the shear-resisting construction unit 200 to the underlying relatively immovable member 3 of the building can be nails, screws, bolts, retrofit bolts, framing anchors, angles, ties, plates, straps or a combination thereof. When the relatively immovable member 3 consists of a plurality of floor diaphragms, a plurality of supporting walls, and the foundation, the means 30 for connecting the shear-resisting construction unit 200 to the relatively immovable member 3 of the building can be nails, screws, bolts, retrofit bolts, framing anchors, angles, ties, plates, straps or a combination thereof.

As shown in FIG. 1, the shear-resisting construction unit 200 rests directly on the relatively immovable member 3.

The first and second chords 28 and 29 of the shear-resisting construction unit 200 may rest directly on the foundation 3. This prevents the plate 16 from being crushed when moment reactions exert compressive forces on the first and second chords 28 and 29.

The means 30 for connecting the shear-resisting construction unit 200 to the relatively immovable member 3 is a foundation anchor anchored to the relatively immovable member 3. The foundation anchor is designed to transmit lateral forces imposed on the relatively immovable member 3 to the shear-resisting construction unit 200.

A washer 31 and a nut 32 can be added to improve the connection and provide resistance to uplift forces on the shear-resisting construction unit 200.

The shear-resisting construction unit 200 also has first and second anchor bolts 17 and 17' that are anchored to the relatively immovable member 3 and are disposed near the first and second chords 28 and 29. The first and second anchor bolts 17 and 17' are received by first and second holdowns 8 and 8'. Nuts 33, fitted onto the first and second anchor bolts 17 and 17', engage the first and second holdowns 8 and 8'. The first and second holdowns 8 and 8' are connected to the first and second chords 28 and 29 by screws.

When the shear-resisting construction unit 200 is sufficiently wide, the shear-resisting construction unit 200 is preferably made with intermediate studs 34 disposed between the top and bottom struts 26 and 27. Spacer blocks 71 and 72 in the present application are optional.

As shown in FIG. 1, the first and second chords 28 and 29 of the shear-resisting construction unit 200 are preferably formed from two elongated wood members 35, laminated together.

Figure 2:
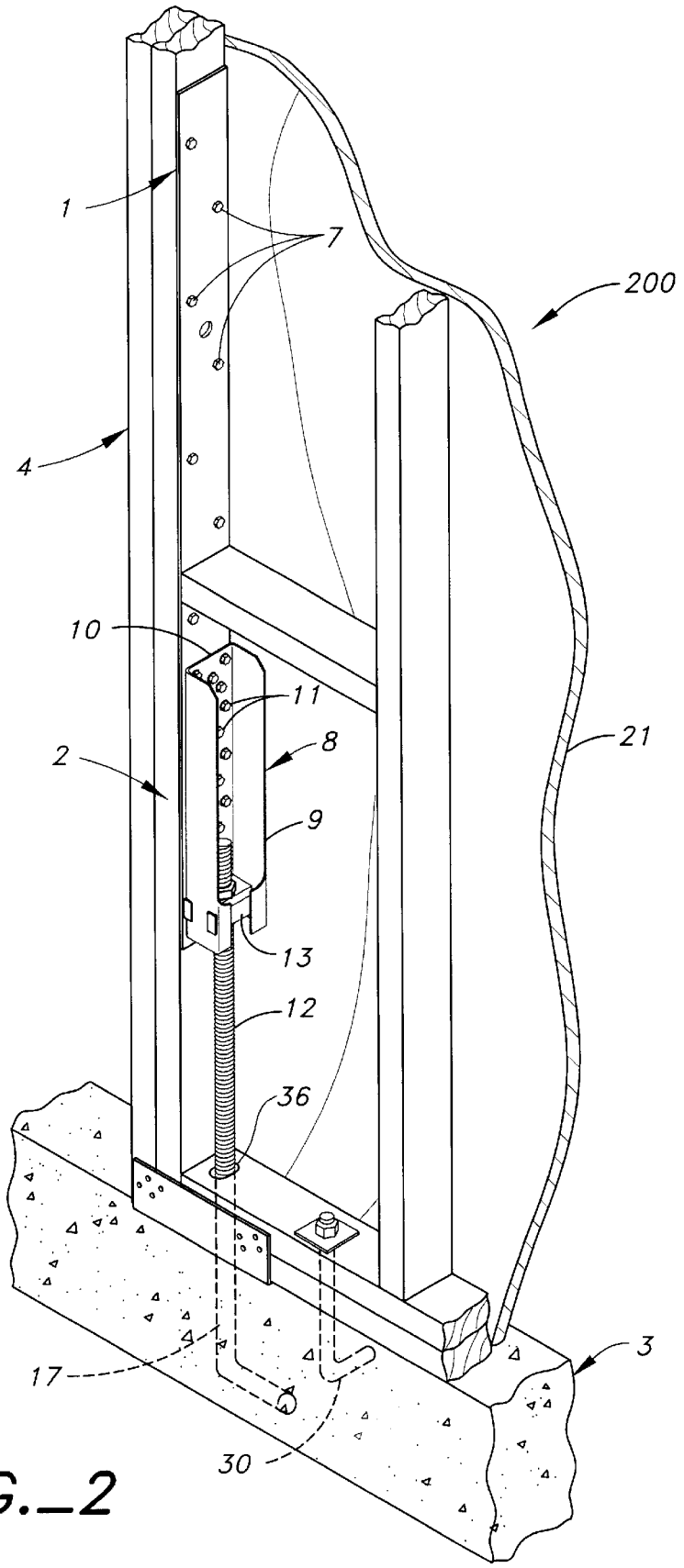
FIG. 2 is an enlarged portion of the shear-resisting construction unit illustrated in FIG. 1 more clearly showing the moment-resisting strap of the present invention in relation to the holdown member.

As an example, the shear resisting construction unit 200 may be constructed as follows: First and second chords 28 and 29 may each be constructed from a 2¾"×3"×90½" SYP Glulam. Top strut 26 may be constructed from a 2¾"×3"×48" SYP Glulam. Bottom strut 27 may be constructed from a 2¾"×3"×42" SYP Glulam with two 1×1⅞" slots 36, 1⅛" from the end of the bottom strut, and two 21/32: ×1⅝" slots 37 6¼" from the end of the bottom strut, and one 1/21/32 ×1⅝" slot 38. centered in the bottom chord. Intermediate studs 34 may be 1 ½"×3"×87¾" and each installed with two 19d ×3" nails from the top and bottom. Planar sheer resisting element 19 may be a single OSB (Structural 1) 47¾"×92½"×15/32" nailed to the struts 26 and 27, and chords 28 and 29. Metal edge strips, not shown in the drawings are nailed to the edges of struts 26 and 27 and chords 28, and 29. Metal plates 39 connect the bottom ends of chords 28 and 29 to bottom strut 27. Holdowns 8 and 8' are attached to chords 28 and 29 as illustrated in FIGS. 1 and 2.

Figure 4:
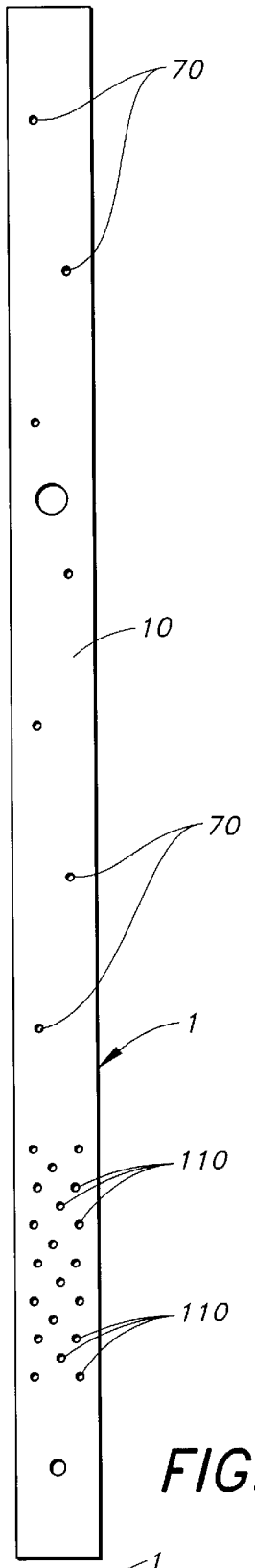
FIG. 4 is an enlarged plan view of the moment-resisting strap of the present invention showing the fastener opening placement in a typical moment-resisting strap.

The moment resisting elongated straps 1 installed on first and second chords 28 and 29 should have a width equal to or slightly less than the width of the chords and have a length extending a substantial portion of the length of the chords and having a thickness and specification calculated for the particular forces required by the specification engineer and or code requirement. The moment resisting elongated straps 1 should terminate at a point just beyond the lower end of the first and second holdowns 8 and 8'. A fastener pattern is illustrated in FIG. 4 and should be provided by the specification engineer and or code requirement. The fasteners used should be ¼×6 inch screws specified by the engineer or by the applicable building code.

Operation of the First Moment Resisting Elongated Strap in the First Shear-resisting Assembly The operation of the first moment resisting elongated strap in the first shear-resisting assembly 2 of the present invention may be best understood by referring to FIGS. 1 and 3. When a shear force 6 acting upon elongated structural member 4 occurs, such as in a seismic event, upward forces are transferred through structural member 4 to the shear resisting assembly 2. Movement of structural member 4 upwardly is resisted by a resistant force 42 exercised by the foundation 3 or other relatively immovable member 3. The shear forces 6 are transmitted to the first holdown 8 along two paths. In the first path, shear force 6 is transmitted through elongated structural member 4 to first holdown member 8 directly through screw fasteners 11 to first holdown 8. In a second path, shear force 6 is transmitted by structural member 4 to first holdown 8 through screw fasteners 7 to first moment resisting strap 1; thence through screw fasteners 11. The shear forces 6 are then transmitted through the seat bracket 13 of the first holdown 8 to the threaded anchor bolt 12 and thence to the foundation 3.

Shear resistance forces 42 and 42', acting downwardly along anchor bolt axis 43, cause moment forces 44 to be set up with moment arm lengths 45 equal to the distance between back face 46 of holdowns 8 and 8' and center line 43 of anchor bolts 12. Shear force 6' thus causes moment resistance forces 42 to rotate the seat brackets 13 of holdowns 8 and 8' in clockwise and counterclockwise directions as shown e.g. by arrow 44; thereby attempting to crush wood fibers 47 and 47' immediately adjacent seat brackets 13 of holdowns 8 and 8'. The moment forces such as moment force 44 further attempt to bend the lower portions of chords 28 and 29 in clockwise and counterclockwise directions respectively.

Because the stitching effect of multiple screws 11 binding holdowns 8 and 8' to first and second moment resisting elongated straps 1 and 1' cause first and second shear-resisting assemblies 2 and 2', including holdowns 8 and 8', a portion of first and second moment resisting elongated straps 1 and 1' in registration with holdowns 8 and 8' and the portions of chords 27 and 28 held by screws 11, to act as stiffening units, bending in chords 28 and 29 adjacent holdowns 8 and 8' is reduced and thus the moment forces 44 are prevented from causing chords 28 and 29 to fail prematurely.

Operation of the First and Second Moment-resisting Elongated Straps in the Shear-resisting Construction Unit The operation of the first and second moment resisting elongated straps in the shear-resisting construction unit 200 of the present invention may be best understood by referring to FIGS. 1 and 3. When a shear force 6' acting upon shear-resisting construction unit 200 occurs, such as in a seismic event, upward forces are transferred through first and second chords 28 and 29 to the shear resisting assemblies 2 and 2'. Upward movement of first and second chords 28 and 29 is resisted by resistance forces 42 and 42' exercised by the foundation 3 or other relatively immovable member 3. The shear forces 6' are transmitted to the first and second holdowns 8 and 8' along two paths. In the first path, shear force 6' is transmitted through first and second chords 28 and 29 to first and second holdown members 8 and 8' directly through screw fasteners 11 to first and second holdowns 8 and 8'.

In a second path, shear force 6' is transmitted by first and second chords 28 and 29 to first and second holdowns 8 and 8' through screw fasteners 7 to first and second moment resisting straps 1 and 1'; and thence through screw fasteners 11.

The shear forces 6' are then transmitted through the seat brackets 13 of the first and second holdowns 8 and 8' to the threaded anchor bolts 12 and 12' and thence to the foundation 3.

Shear resistance force 42, acting downwardly along anchor bolt axis 43, causes a moment force 44 to be set up with a moment arm length 45 equal to the distance between back face 46 of holdown 8 and center line 43 of anchor bolt 12. Moment force 6' thus causes moment resistance force 42 to rotate the seat bracket 13 of holdown 8 in a clockwise direction as shown by arrow 44; thereby attempting to crush wood fibers 47 immediately adjacent seat bracket 13 of holdown 8. The moment force 44 further attempts to bend the lower portion of structural member 4 in a clockwise direction as shown in FIG. 3.

Because the stitching effect of multiple screws 11 binding holdown 8 to first moment resisting elongated strap 1 causes first shear-resisting assembly 2, including holdown 8, a substantial portion of first moment resisting elongated strap 1 in registration with holdown 8 and a substantial portion of elongated structural member 4 held by screws 11, to act as a stiffening unit of substantial length, bending in elongated structural member 4 adjacent holdown 8 is reduced and thus the moment force 44 is prevented from causing structural member 4 to fail prematurely.

Shear forces can also be caused by lateral forces 5 acting on the shear resisting construction unit 200. Such a lateral force 5 translates to an upward force component acting on second chord 29 and is resisted by the same elements in the same manner discussed immediately above.

Lateral force 5 acting upon the shear resisting construction unit 200 has resulted in a limitation of the structure to meet higher moment forces resulting from specific seismic and wind events.

Specifically, referring to FIG. 3, it may be seen that a shear force 6 acting along axis 41 of second chord 29 is resisted by a resistance force 42 acting downwardly along axis 43 of threaded anchor 12. These two equal and opposite shear forces result in a moment force indicated by arrow 44 in FIG. 3 having a moment arm 45 equal to the distance between axis 42 of the threaded bolt 12 and the axis 41 of the second chord 29. Moment force 44, prior to the provision of moment resisting elongated strap 1 caused the lower end 14 of holdown to bend and rotate the same direction as moment force 44 indicated by the arrow. This bending of the end of the holdown caused two problems. First, the bending of end 14 of holdown 8 caused localized crushing of the wood fibers adjacent to the end 14 of holdown 8. This crushing of the wood fibers 47 caused a weakening of the second chord 29 in compression. Second, bending of the end 14 of the holdown 8' set up a rotational force in the second chord 29 in the same direction as arrow 44. Under certain severe conditions, the onset of failure of the wood second chord 29 was detected which could result in a premature failure of the entire shear resisting assembly 2. After detecting the results of the tremendous moment forces in the structure, efforts were made to reduce the eccentricity and resulting moment forces resulting from the distance 45 between threaded bolt axis 43 and second chord axis 41. Various forms of holdowns were tried with limited results. Since it is presently unknown how to eliminate all eccentricity, the present solution of providing a moment resisting elongated strap member 1 was proposed. Since a thin metal strap has a negligible resistance to bending and since holdowns were using bolts for attachment of the holdown to the wood chord 29, some, but not significant improvement was noted. The breakthrough occurred when the holdown 8 was attached to the first moment resisting elongated strap 1 and the second wood chord member by attachment means deployed along a substantial portion of the length of the holdown 8.

The attachment means may be accomplished by adhesive, or fasteners such as nails , screws. or bolts in predrilled bores. The important criteria is using all attachment means is that looseness or slip between the wood structure and the moment resisting elongated strap be minimized.

Figure 5:
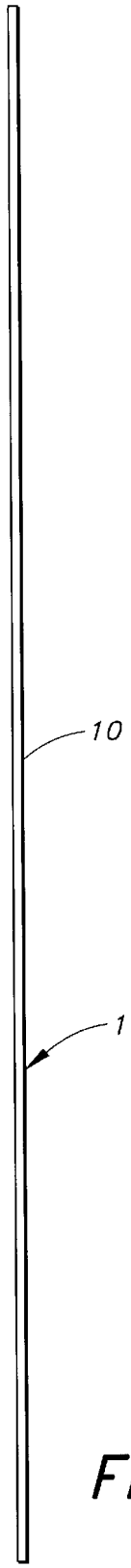
FIG. 5 is an edge view of the moment-resisting strap illustrated in FIG. 4.
Figure 6:
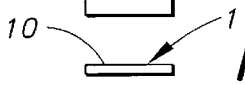
FIG. 6 is an end view of the moment-resisting strap illustrated in FIGS. 4 and 5.

A preferred best mode moment resisting elongated strap 1 is illustrated in FIGS. 4, 5 and 6. As an example, strap 1 may be of 12 gauge steel having a length of 51¼" and a width of 2¾". In a best mode form, using screw fasteners, openings should be formed in the metal as follows: In the upper portion of strap 1, openings 70 should be formed and spaced at intervals of about 5" with an end edge spacing of about 3¾". The openings should be staggered with a side edge distance of about 27/32".

The openings 110 in the strap 1 for registration with the openings in the holdown, must, however, have a much closer spacing. When used with screws, e.g. twenty ¼" screws are required to hold the loads imposed and which must be transferred from the elongated wood structural member 4, for example, to the holdowns 8 and 8'. Typically the openings 110 are arranged in three rows with the spacing in each row being staggered as typically required to prevent wood splitting. Typically, the longitudinal spacing between any opening of each of the three rows should be a minimum of ⅝" with an edge distance of between ⅝" to ¾". The center row of staggered screws should have an edge spacing of 1/1/4". The distance of the lowermost openings 110 should be about 6" from the lower edge of the strap 1.

Selection of an elongated strap 1 interposed between the metal holdown 8 and the wood structural member resulted in three different benefits which conjointly resulted in the ability of the connection to safely withstand greater shear and moment forces.

The first objective in transferring large shear forces from the wood frame to the foundation is fairly straightforward. By providing a long strap 1, shear loads were transferred through the spaced fasteners 7 over a relatively long distance. Rather than concentrating the load transfer from the wood member 4 only at closely spaced screws 11 at the holdown 8. By taking the shear load out of the wood member 4 beginning at the top of the strap and transferring it to the metal strap 1, by the time the shear forces in the wood member 4 approached the holdown, much of the stress had already been transferred to the metal strap 1. This arrangement enabled the holdown to be shortened, thereby reducing the weight and length of the holdown 4.

While the elongated strap 1 transferred shear forces effectively, a much more important solution to the moment forces 44 initiating in the holdown 8 occurred. Premature failures in chords 28 and 29 due to lateral shear forces 5 imposed on shear-resisting construction unit 200 were curbed. The reasons for this sudden successful result are not readily apparent.

Composite Effect

Two analogies are set forth to explain the success of the elongated strap 1 are herein suggested.

First, consider the action of a steel rebar in a concrete beam. It is well known that placing the high tension steel rebar in the lower part of the concrete beam counters the bending moments and enables the beam to carry much greater loads. The key to the success of the rebar element is it's ability to remain within and in interlocking contact with the concrete for a relatively long distance without slipping. In other words, the forces in the lower portion of the concrete are only transferred to the rebar to place it in tension, if the forces are distributed along a substantial length of the rebar without slipping in relation to the concrete. In like manner, shear forces must be distributed along a substantial portion of the elongated strap 1 of the present invention without slipping. This is accomplished by fastening the steel strap 1 either continuously by adhesives, or at frequent intervals by fasteners such as wood screws. This joinder of elements, causes the elements to act conjointly, resulting in a composite effect.

A second analogy also is instructive in understanding the result obtained by use of an elongated strap 1. Consider for example, the need to span a relatively long distance in building construction. If one were to use three elements, and arrange them in the configuration of an "I"; namely a wood beam on edge for a web and two boards with one placed on its side at the top of the web board and a second board on its side at the bottom of the web board, if none of the boards were connected this three element "beam" would have a relatively low threshold in its ability to hold loads. On the other hand, if all three boards were continuously or nearly continuously joined together, we now have what is commonly known as an "I" beam which has well know characteristics in holding large loads over relatively long spans.

Again, applying the foregoing analogy to the present invention, The combined wood frame member 4 and the elongated strap 1, if not joined together, have little additional ability to withstand moment forces. On the other hand, if continuously or joined at relatively short intervals, the combined or composite assembly can resist much greater moment forces if the members are not permitted to slip relative to one another over a substantial portion of their length.

In addition to the increased moment and shear resistance due to the use of a strap 1, further enhanced moment resistance is achieved by using a holdown with longitudinal stiffening means such as is provided with at least one and preferably two flanges 9. Thus the entire assembly acting cooperatively as a sandwich by the stitching effect of the multiple fasteners which stitch the entire assembly together composed of the flange 9, the back face 46 of holdown 8, the moment resisting elongated strap 1 and the wood second chord member 29 provides a moment resisting structure to prevent the bending of the end 14 of holdown 8. The effect of this stiffening structure has been the increased ability of the shear resisting assembly 2 to withstand greater forces imposed by seismic and wind events. While a detailed operation of the forces on second chord member 29 and first holdown 8 has been described. A similar operation of shear and moment forces occurs on holdown 8' and first chord 28 when a reversal of lateral forces 5 occurs and is not repeated for purposes of brevity. Thus for a relatively small expenditure of money in replacing bolts with screws and the addition of a moment resisting elongated strap in the form of a relatively thin metal strap, greatly improved structural strengthening has been achieved.

It is recommended that screws 7 and 11 be special shear resistant wood screws manufactured by Simpson Strong-Tie Company Inc. and sold under the designation SDS™ ¼×3 or SDS™ 1/4/×6 for best results. These screws are fully described in U.S. Pat. No. 6,109,850 granted Aug. 29, 2000

I claim:

1. A bending moment-resisting strap connection in a shear-resisting assembly including an elongated generally vertical wood structural member subject to moment and shear forces operatively connected to a relatively immovable member comprising:

a. an individually separate metal elongated bending moment-resisting strap positioned in registration with said elongated wood structural member;

b. a metal holdown member separate from said moment resisting strap eccentrically connected to said relatively immovable member and having a face member substantially shorter in length than the length of said strap positioned in abutting relation to a portion of said elongated moment-resisting strap;

c. a plurality of first attachment means penetrating said moment resisting strap therethrough and penetrating said wood structural member to a depth at least exceeding one half the thickness of a single structural member or through all intervening layers of a multiple layered structural member and at least one-half the thickness of the outer layer of said multiple layered structural member, and at sufficient multiple locations distributed across substantially the entire area of said moment resisting strap and in a manner such that said strap and wood structural member conjointly act compositely and substantial shear and moment forces are operatively transmitted from a substantial length and cross section of said elongated structural member to said relatively immovable member;

d. a plurality of second attachment means penetrating said face member of said holdown and said moment resisting strap therethrough and penetrating said wood structural member to a depth at least exceeding one half the thickness of a single structural member or through all intervening layers of a multiple layered structural member and at least one half the thickness of the outer layer of said multiple layered structural member, and connecting said face member of said holdown to said individually separate elongated moment-resisting strap and said elongated wood structural member at sufficient multiple locations distributed across substantially the entire area of said face member of said metal holdown thereby stitching said moment resisting strap to said face member of said metal holdown, so as to stiffen said shear-resisting assembly and transmit greater moment and shear forces from said elongated structural member to said relatively immovable member; and e. said bending moment resisting strap having a length extending the full length of said face member of said metal holdown member and extending and continuously attached across a substantial portion of the length of said face member of said metal holdown, and wherein said bending moment resisting strap member is continuously attached to said elongated wood structural member at least to the mid length of said wood structural member.

2. A bending moment-resisting strap connection as defined in claim 1 comprising:

a. said metal holdown member is formed with longitudinal stiffening means connected to substantially the entire length of said face member.

3. A bending moment-resisting strap connection as defined in claim 2 wherein:

a. said holdown member stiffening means is a pair of laterally spaced flanges connected to substantially the entire length of said face member of said holdown member.

4. A bending moment-resisting strap connection as defined in claim 1 wherein:

a. said metal holdown member includes a seat attached to said face member at a location upwardly from the end of said face member and said seat member is operably connected to an anchor embedded in said relatively immovable member; and b. said bending moment resisting strap extends a measurable distance below said face member of said holdown member.

5. A bending moment-resisting strap connection as defined in claim 1 wherein:

a. said relatively immovable member is a concrete foundation;

b. said holdown member having a seat attached to said face member at a location upwardly from the end of said face member; and c. said bending moment resisting strap extends a measurable distance below said face member of said holdown member.

6. A bending moment-resisting strap connection as defined in claim 1 wherein:

a. said first attachment means are wood screws.

7. A bending moment-resisting strap connection as defined in claim 2 wherein:

a. said stiffening means is at least one flange connected to substantially the entire length of said face member of said holdown member.

8. A bending moment-resisting strap connection as defined in claim 1 wherein:

a. said operable eccentric connection includes an anchor embedded in said relatively immovable member connected to a bracket on said holdown member integrally connected to said holdown face member.

9. A bending moment-resisting strap connection as defined in claim 2 wherein:

a. said second attachment means is a plurality of wood screw fasteners.

10. A bending moment-resisting strap connection as defined in claim 4 including a second generally vertical wood structural member generally parallel to said first named wood structural member and subject to moment and shear forces operatively connected to a relatively immovable member wherein said shear-resisting construction unit forms a wall unit including a second shear-resisting assembly comprises:

a. a second elongated bending moment-resisting strap positioned in registration with a second elongated structural member on a side of said second elongated structural wood member opposite to said first named wood structural member and attached with wood screws at sufficient multiple locations and in a manner such that said second strap and said second wood structural member conjointly act compositely and substantial shear and moment forces are transmitted from a substantial length and cross section of said second elongated structural member to said concrete foundation;

b. a second metal holdown member having a second face member substantially shorter in length than the length of said second bending moment resisting strap, and a second seat attached to said second face member at a location upwardly from the end of said second face member, said second face member, including the portion located below said second seat member, being positioned in abutting relation to said bending moment resisting strap, a pair of laterally spaced flanges connected to substantially the entire length of said second face member, and said second seat member being operably connected to a second anchor embedded in said foundation;

c. second attachment means connecting said face member of said second holdown to said second elongated bending moment-resisting strap and to a substantial length and cross section of said second elongated structural wood member such that said second shear resisting assembly is stiffened and substantial shear and moment forces are transmitted from said second elongated structural member to said concrete foundation; and d. a planar shear-resisting element joining said first and second elongated structural members for conjoint shear force transferal.

* * * * *